US009463954B2

(12) United States Patent
Kumar et al.

(10) Patent No.: US 9,463,954 B2
(45) Date of Patent: Oct. 11, 2016

(54) ACCESS CONTROL SYSTEM FOR OVERRIDE ELEVATOR CONTROL AND METHOD THEREFOR

(71) Applicant: Sensormatic Electronics, LLC, Boca Raton, FL (US)

(72) Inventors: Saravana Kumar, Karnataka (IN); Jason M. Ouellette, Southbridge, MA (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 576 days.

(21) Appl. No.: 13/961,158

(22) Filed: Aug. 7, 2013

(65) Prior Publication Data

US 2014/0305747 A1 Oct. 16, 2014

Related U.S. Application Data

(60) Provisional application No. 61/810,326, filed on Apr. 10, 2013.

(51) Int. Cl.
*B66B 1/20* (2006.01)
*B66B 1/46* (2006.01)

(52) U.S. Cl.
CPC ..... *B66B 1/468* (2013.01); *B66B 2201/4676* (2013.01)

(58) Field of Classification Search
CPC ..... B66B 1/468; B66B 2201/4676
USPC ..... 187/247, 380–389, 391, 393
See application file for complete search history.

(56) References Cited

U.S. PATENT DOCUMENTS 5,749,443 A * 5/1998 Romao ..... B66B 1/468 187/384
7,040,458 B2 * 5/2006 Forsythe ..... B66B 1/34 187/389
7,353,915 B2 * 4/2008 Zaharia ..... B66B 1/468 187/388
7,620,817 B2 * 11/2009 Friedli ..... B66B 1/468 116/64
7,823,700 B2 * 11/2010 Boss ..... B66B 1/468 187/247
8,151,942 B2 * 4/2012 Rusanen ..... B66B 1/468 187/247

(Continued)

FOREIGN PATENT DOCUMENTS

WO 2011075115 A1 6/2011

OTHER PUBLICATIONS

International Preliminary Report on Patentability, mailed on Mar. 16, 2015, from counterpart International Application No. PCT/US2014/013886, filed on Jan. 30, 2014.

(Continued)

*Primary Examiner* — Anthony Salata
(74) *Attorney, Agent, or Firm* — HoustonHogle LLP

(57) ABSTRACT

A system and method for an access control system for an elevator system that overrides landing matrices that define the access to the floors in the elevator system. The system overrides the landing matrices of the access control system in response to conditions defined by security system operators, such as emergency situations, and sends the landing matrices to elevator controllers for controlling the access to the floors. In examples, the system supports configuration of vendor-neutral landing matrix objects sent to the access control system over a security network for creating new landing matrices, and overriding the contents of the existing landing matrices.

26 Claims, 6 Drawing Sheets

(56) References Cited

U.S. PATENT DOCUMENTS

| | | | | |
|---|---|---|---|---|
| 8,301,456 | B2 * | 10/2012 | Gazdzinski | G06Q 30/0251 187/384 |
| 8,387,757 | B2 * | 3/2013 | Christy | B66B 1/2458 187/387 |
| 8,490,754 | B2 * | 7/2013 | Amano | B66B 1/2458 187/384 |
| 8,813,917 | B2 * | 8/2014 | Salmikuukka | B66B 1/468 187/247 |
| 9,156,653 | B2 * | 10/2015 | Flynn | B66B 1/468 |
| 2012/0305340 | A1 * | 12/2012 | Wu | B66B 1/34 187/381 |
| 2016/0009525 | A1 * | 1/2016 | DePaola | B66B 1/468 187/380 |

OTHER PUBLICATIONS

International Search Report and Written Opinion of the International Searching Authority, mailed on May 28, 2014, from counterpart International Application No. PCT/US2014/013886, filed on Jan. 30, 2014.

Kone Polaris, "The Destination Control System for Optimized People Flow" pp. 1-12., 2010.

* cited by examiner

300

301

| Front Door Floors | | | | | | | |
|---|---|---|---|---|---|---|---|
| 1 | 2 | 3 | 4 | 5 | 6 | 7 | 8 |
| 9 | 10 | 11 | 12 | 13 | 14 | 15 | 16 |
| 17 | 18 | 19 | 20 | 21 | 22 | 23 | 24 |
| 25 | 26 | 27 | 28 | 29 | 30 | 31 | 32 |
| 33 | 34 | 35 | 36 | 37 | 38 | 39 | 40 |
| 41 | 42 | 43 | 44 | 45 | 46 | 47 | 48 |
| 49 | 50 | 51 | 52 | 53 | 54 | 55 | 56 |
| 57 | 58 | 59 | 60 | 61 | 62 | 63 | 64 |
| 65 | 66 | 67 | 68 | 69 | 70 | 71 | 72 |
| 73 | 74 | 75 | 76 | 77 | 78 | 79 | 80 |
| 81 | 82 | 83 | 84 | 85 | 86 | 87 | 88 |
| 89 | 90 | 91 | 92 | 93 | 94 | 95 | 96 |
| 97 | 98 | 99 | 100 | 101 | 102 | 103 | 104 |
| 105 | 106 | 107 | 108 | 109 | 110 | 111 | 112 |
| 113 | 114 | 115 | 116 | 117 | 118 | 119 | 120 |
| 121 | 122 | 123 | 124 | 125 | 126 | 127 | 128 |
| Rear Door Floors | | | | | | | |
| 1 | 2 | 3 | 4 | 5 | 6 | 7 | 8 |
| 9 | 10 | 11 | 12 | 13 | 14 | 15 | 16 |
| 17 | 18 | 19 | 20 | 21 | 22 | 23 | 24 |
| 25 | 26 | 27 | 28 | 29 | 30 | 31 | 32 |
| 33 | 34 | 35 | 36 | 37 | 38 | 39 | 40 |
| 41 | 42 | 43 | 44 | 45 | 46 | 47 | 48 |
| 49 | 50 | 51 | 52 | 53 | 54 | 55 | 56 |
| 57 | 58 | 59 | 60 | 61 | 62 | 63 | 64 |
| 65 | 66 | 67 | 68 | 69 | 70 | 71 | 72 |
| 73 | 74 | 75 | 76 | 77 | 78 | 79 | 80 |
| 81 | 82 | 83 | 84 | 85 | 86 | 87 | 88 |
| 89 | 90 | 91 | 92 | 93 | 94 | 95 | 96 |
| 97 | 98 | 99 | 100 | 101 | 102 | 103 | 104 |
| 105 | 106 | 107 | 108 | 109 | 110 | 111 | 112 |
| 113 | 114 | 115 | 116 | 117 | 118 | 119 | 120 |
| 121 | 122 | 123 | 124 | 125 | 126 | 127 | 128 |

Fig. 3

ACCESS CONTROL SYSTEM FOR OVERRIDE ELEVATOR CONTROL AND METHOD THEREFOR

RELATED APPLICATIONS

This application claims the benefit under 35 U.S.C. §119 (e) of U.S. Provisional Application No. 61/810,326, filed on Apr. 10, 2013, which is incorporated herein by reference in its entirety.

BACKGROUND OF THE INVENTION

Elevator systems in buildings typically utilize an elevator controller to control one or more elevators. Typically, elevator systems are integrated with security control systems that provide landing matrices to the elevator controllers for controlling the access to the floors. Elevator systems with integrated access control systems are also referred to as elevator integrations, and communicate over a security network with the security control system.

The landing matrices define access to the floors on a time, per-floor, and/or per-user basis, and are typically stored in an access control system ("ACS") of the security control system. Security personnel create and configure the landing matrices using management applications on workstations. Typically, the elevator controllers accept one landing matrix at a time for controlling the access to the floors. Based on security objectives, security personnel select a landing matrix on the ACS, also known as the active landing matrix, and send the active landing matrix to the elevator controller to control the access to the floors.

Security personnel create and select landing matrices for controlling access to the floors based with daily working conditions in the buildings. Default landing matrices typically provide floor access to all users with the exception of secured floors. User-specific matrices, or cardholder matrices, can provide the ability for individual users or groups of users to access one or more otherwise secured floors.

For the cardholder matrices, users typically provide their credentials over the security network via card readers. The user credentials are included within access cards created by security personnel. The card readers send the user credentials to the access control system to authenticate the users. Upon authenticating the users, the access control system can select associated cardholder matrices that grant access to the floors.

SUMMARY OF THE INVENTION

Current elevator integrations have difficulty handling and implementing exceptions to normal behavior, such as the need to change access to the floors in response to emergency conditions. Existing systems typically require that security personnel manually configure an active landing matrix on the ACS that provides access to all floors, and send it to the elevator controller for an indefinite time period. To clear the emergency condition, security personnel manually revert the active landing matrix to the landing matrix used prior to the emergency condition.

The present invention provides the ability to define access to one or more floors on a per-exception basis, and apply the exception as an override to the stored landing matrices on the ACS. This includes overriding the active landing matrix. The override can be applied manually by an operator for an indefinite or a fixed time, and can be scheduled in advance via a scheduler on the ACS.

The ACS sends the overridden contents of the active landing matrix to the elevator controller to control the access to the floors for the duration of the override event. Upon the completion of a fixed time or scheduled override, the ACS automatically reverts to using the landing matrix utilized prior to the override as the active landing matrix, and sends the new active landing matrix to the elevator controller. In addition, the present invention also provides the ability to define personnel exceptions to the overrides, such as emergency responders or security personnel.

Moreover, current manufacturers of elevator systems implement proprietary mechanisms for configuring and defining the access to the floors. The present invention also provides a vendor-neutral format for defining and overriding the access to the floors via landing matrix objects. Using the landing matrix objects, elevator vendors can also implement the access override capabilities of the present invention by integrating the content of the landing matrix objects with proprietary application programming interfaces ("API").

In embodiments of the access control system, an ACS landing matrix API or framework is used that supports vendor-neutral requests for overriding the contents of the landing matrices on the ACS, and submits landing matrix to override the currently active landing matrix for the elevator controller in response to the requests.

The embodiments of the invention utilize a landing matrix object that operators configure using management applications. The landing matrix object supports information associated with standard landing matrix configuration, as well as for specifying override behavior.

This includes the ability to secure or unsecure a given elevator floor indefinitely or for a fixed period of time, to provide temporary floor access through a manual action for visitors not having routine access to floors.

The landing matrix object also includes an override exemption list that grants access to individuals whose user credentials are included in the override exemption list. This allows individuals such as emergency responders to gain access to otherwise secure floors during an override event in response to emergency conditions.

In general, according to one aspect, the invention features a security control system for an elevator system, which comprises an elevator controller that controls access to floors served by one or more elevators, and an access control system that stores one or more landing matrices that define the access to the floors, the access control system providing the landing matrices to the elevator controller. The access control system includes a landing matrix API that accepts landing matrix objects in messages received over a security network, the landing matrix API overriding the landing matrices with the landing matrix objects. The security control system also comprises a security network control system that enables configuration of the landing matrix objects, and sends the landing matrix objects in the messages to the access control system over the security network.

The system further comprises one or more card readers that receive user credentials from users, and send the user credentials in the messages over the security network to the access control system. The card readers are included within car operation panels and/or destination operation panels.

The landing matrix API creates new landing matrices from the landing matrix objects. In response to the messages received over the security network, the access control system preferably selects one of the landing matrices as an active landing matrix, and sends the active landing matrix to the elevator controller to control the access to the floors.

The elevator controller executes an active landing matrix sent by the access control system to control the access to the floors, and executes the landing matrices sent by the access control system to control the access to the floors.

The landing matrices include a default offline matrix utilized by the elevator controller when the access control system is unable to communicate with the elevator controller. The landing matrices also include one or more user specific matrices associated with cardholders, which the access control system sends to the elevator controller in response to receiving user credentials associated with users, when the access control system authorizes the user credentials for the users.

The landing matrices further include a default online matrix, which the access control system sends to the elevator controller when the access control system communicates with the elevator controller, and no user credentials are received in the messages over the security network.

In embodiments, the access control system further comprises a scheduler for providing the landing matrices to the elevator controller according to a schedule.

The security control system includes a configuration application for configuring the landing matrix objects. Preferably, the security control system further comprises a security guard workstation that includes a security management application for enabling configuration of the landing matrix objects and for providing the landing matrix objects to the access control system in the messages sent over the security network.

The security guard workstation typically includes a display device for displaying the security management application, and a keyboard and a pointing device for configuring the landing matrix objects in the security management application.

Preferably, the landing matrix objects provide a vendor-neutral format for overriding the landing matrices sent to the elevator controller. The landing matrix objects include bitmasks for defining the access to the floors associated with cab doors of the elevators; a user credentials list that includes user credentials for defining the access to the floors associated with users; a landing matrix type field that defines operations for the landing matrix API to perform from contents of the landing matrix objects; and a time limit field that specifies a duration associated with the operations of the landing matrix type field.

In general, according to another aspect, the invention features a security control method for an elevator system. The security control method comprises an access control system providing a landing matrix API that accepts landing matrix objects in messages received over a security network; in the access control system, storing one or more landing matrices defining access to floors by one or more elevators; the access control system receiving the landing matrix objects from a security network control system, and overriding the stored landing matrices with the landing matrix objects; and providing the landing matrices to an elevator controller of the elevator.

The security control method further comprises receiving user credentials from users via card readers, and sending the user credentials in the messages over the security network to the access control system.

In one implementation, the security control method further comprises the landing matrix API creating new landing matrices from the landing matrix objects.

Preferably, in response to receiving the messages over the security network, the access control system selects one of the landing matrices as an active landing matrix, and sends the active landing matrix to the elevator controller to control the access to the floors.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings:

FIG. 3 is an exemplary graphical user interface for building bitmasks for the ACS landing matrix object's Front cab door bitmask and Rear cab door bitmask for elevator floor access;

DETAILED DESCRIPTION OF THE PREFERRED EMBODIMENTS

Figure 1:
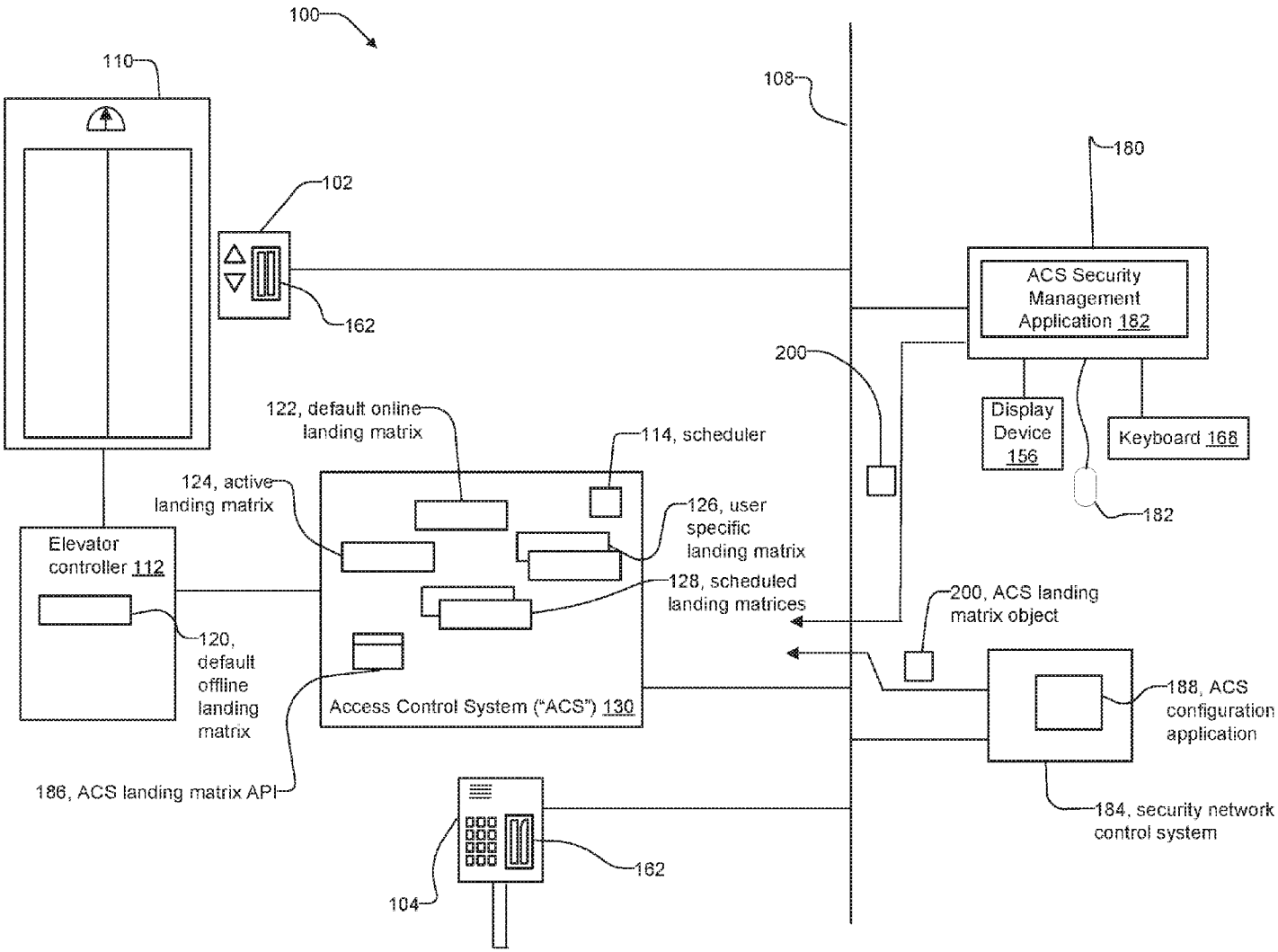
FIG. 1 is a schematic diagram of a security system including an elevator system that includes an access control system ("ACS") for controlling access to floors serviced by elevators, and further illustrates the configuration of landing matrices for normal and override user access.

FIG. 1 illustrates an elevator system 100 that includes an Access Control System ("ACS") 130 that communicates with an elevator controller 112. The elevator controller 112 controls one or more elevators 110. The ACS 130 connects to a security network 108. Operators of the elevator system 100, such as security guards, configure one or more landing matrices for the ACS 130. The landing matrices include information such as the list of floors for the elevator system, and the elevator doors front and/or rear for each elevator car.

The ACS 130 includes one or more landing matrices that define the access to the floors for the elevator controller 112. When the communications between the ACS 130 and the elevator controller 112 are active, the ACS 130 sends a landing matrix to the elevator controller 112 for controlling access to the floors served by the elevators 110. The elevator controller 112 includes a default offline landing matrix 120 in the event that the communications fail between the ACS 130 and the elevator controller 112.

The landing matrices also include a default online landing matrix 122 that specifies access to floors independent of user credentials, and one or more user-specific landing matrices 126 that include user credential information from users. The ACS 130 creates the user-specific matrices in response to receiving the user credentials over the security network 108 from card readers 162.

While the ACS 130 stores one or more landing matrices, only one landing matrix at any given time is sent by the ACS 130 to the elevator controller for controlling the access to the floors. This is also known as an active landing matrix 124. The active landing matrix 124 is the matrix sent by the ACS 130 to the elevator controller 112 for granting the access to the floors served by the elevators 110 when the connection between the elevator controller 112 and the access control system 130 is active.

The ACS 130 also includes scheduled landing matrices 128 that the ACS 130 schedules with its scheduler 112. A scheduled landing matrix 128 becomes the active landing matrix 124 during the scheduled time of the scheduler 112. Once the scheduler 112 completes, the ACS 130 reverts to using the active landing matrix 124 utilized prior to the scheduling event, which is typically the default online landing matrix 122.

The ACS 130 additionally includes an ACS landing matrix API 186 that accepts ACS landing matrix objects 200 included within messages over the security network 108. In response to receiving the ACS landing matrix objects 200, the ACS landing matrix API 186 reads the ACS landing matrix objects 200, creates new landing matrices from the ACS landing matrix objects 200, and performs operations upon the stored landing matrices using the ACS landing matrix objects 200.

Users can request access to the elevator system 100 via access card readers 162 included within Destination Operation Panels ("DOP") 104 and Car Operation Panels ("COP") 102. COPs 102 are located within an elevator car of the elevator 110, or mounted outside elevator doors of the elevator 110. DOPs 104 are typically located in natural entrance areas within close proximity of an elevator lobby. Users present access cards to the card readers 162 that include user credentials, and the card readers 162 send the user credentials in messages over the security network 108 to the ACS 130.

Personnel such as security guards configure access to the elevator system 100 via a security guard workstation 180 and a security network control system 184. The security guard workstation 180 and the security network control system 184 connect to the security network 108. The security guard workstation 180 has a display device 156, a pointing device 182, such as a mouse or touchscreen, and a keyboard 168. The security guard workstation 180 includes an ACS security management application 182.

In typical elevator systems 100, one vendor manufactures the majority of the components that communicate over the security network 108, such as the elevator controller 112, the ACS 130, the COPs 102 and DOPs 104. In addition, vendors provide full management and configuration for these components via vendor-specific security ACS security management applications 182 on the security guard workstation 180.

In contrast, the security network control system 184 is typically a third party system, the capabilities of which are limited to configuration and management of the ACS 130 and its landing matrices via the ACS configuration application 188.

A security guard uses the ACS security management application 182 on the security guard workstation 180 for configuration and management of the ACS 130 and its landing matrices. The ACS security management application 182 typically supports all functions of the ACS 130. Security personnel also configure information for the landing matrices of the ACS using the ACS configuration application 188 on the security network control systems.

Security personnel configure information for creating and modifying the landing matrices in response to security objectives, and in response to changes in operational conditions. Operators use the ACS configuration application 188 and the ACS security management application 182 to create ACS landing matrix objects 200. The ACS landing matrix objects 200 are sent over the security network 108 to the ACS to create new landing matrices, and to apply the content of the landing matrix objects 200 to the stored landing matrices of the ACS 130.

Figure 2:
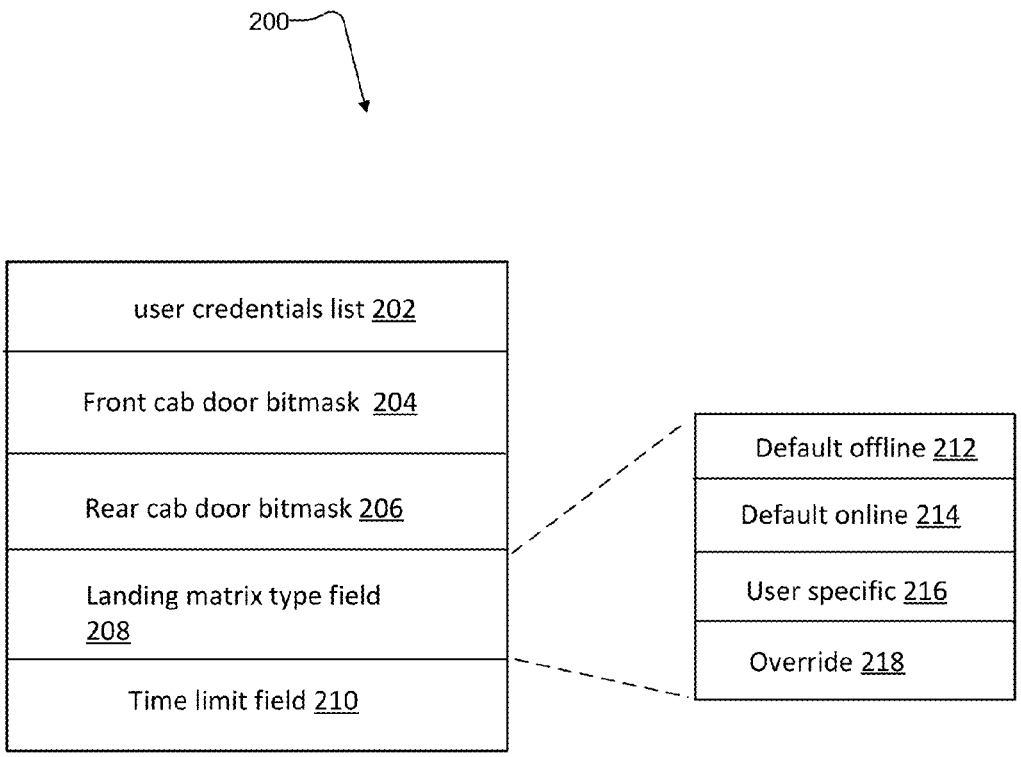
FIG. 2 illustrates the fields of the ACS landing matrix object, which is used to configure override access of the landing matrices of the ACS.

FIG. 2 defines the fields of the ACS landing matrix objects 200. An operator of the system configures the ACS landing matrix objects 200 via the ACS Security Management Application 182 on the security guard workstation 180, or via the ACS configuration Application 188 on the security network control system 184.

The ACS landing matrix objects 200 include fields that specify access to floors within a building. The ACS landing matrix objects 200 support one or two elevator doors per elevator car. The fields of the ACS landing matrix objects 200 include a context-specific user credentials list 202, a front cab door bitmask 204, a rear cab door bitmask 206, a landing matrix type field 208, and a time limit field 210.

The user credentials list 202 is context-specific, depending on the value of the landing matrix type field 208. The user credentials list 202 includes a list of user credentials associated with users.

The front cab door bitmask 202 and rear cab door bitmask 204 define access to elevator floors for the front cab door and rear cab door, respectively, of an elevator 110. The front cab door bitmask 202 and rear cab door bitmask 204 define access for as many as 128 floors, in one implementation, as shown in FIG. 3.

In one example, positions within the front cab door bitmask 202 and rear cab door bitmask 204 are associated with floor numbers. A zero (0) value for the position indicates secure or denial of access to that floor, and a one (1) value for the position indicates unsecure or granting of access to that floor.

The time limit field 210 is context-specific, depending on the value of the landing matrix type field 208. In one example, the time limit field 210 is supported when the landing matrix type 208 is set to override 218. The value of the time limit field 210 specifies the duration for the associated override 218. In one embodiment, the time limit field 210 value is defined in seconds, with a value of 0 associated with an indefinite time period.

The landing matrix type 208 includes the following types: default offline 212, default online 214, user specific 216, and override 218. The ACS 130 uses the ACS Landing matrix API 186 to read the contents of ACS Landing matrix objects 200 received in messages over the security network 108.

The security guard workstation 180 and the security network control system 184 send the ACS landing matrix objects 200 in response to requests for configuration changes to the landing matrices by operators. In response to receiving the ACS Landing matrix objects 200, the ACS Landing matrix API 186 instructs the ACS 130 to configure the landing matrices on the ACS 130 and/or designate one of the landing matrices as the active landing matrix 124, and send the active landing matrix 124 to the elevator controller 112 for controlling the access to the floors.

Operators specify the default offline 212 type for the landing matrix type 208 for configuring parameters associated with the default offline landing matrix 120. The user credentials list 202 and time limit fields 210 are not supported for the default offline 212 type.

In response to receiving an ACS landing matrix object 200 with the default offline 212 type specified, the ACS landing matrix API 186 instructs the ACS 130 to create a new default offline landing matrix 120. However, the ACS 130 does not assign the newly created default offline landing matrix 120 as the active landing matrix 124. Rather, the ACS 130 sends the newly created default offline landing matrix 120 to the elevator controller 112, which the elevator controller 112 uses to provide access to the floors when the ACS 130 is no longer communicating with the elevator controller 112.

The operator defines the values in the front cab door bitmask 202 and rear cab door bitmask 204 for controlling the access to the floors independent of user credentials. Typical examples include secure access to all floors, unsecure access to all floors, or a custom matrix of secure and unsecure access to floors.

Operators specify the default online 214 type for the landing matrix type 208 for configuring parameters associated with the default online landing matrix 122. The ACS 130 utilizes the default online landing matrix 122 as the active landing matrix 124 when the connection between the ACS 130 and the elevator control 112 is active, and the ACS 130 is not receiving messages over the security network 108 that include user credentials associated with users requesting access from card readers 162.

As with the default offline 212 type, the default online 214 type utilizes the front cab door bitmask 202 and rear cab door bitmask 204 of the ACS landing matrix object 200 for controlling floor access independent of user credentials. The user credentials list 202 and time limit fields 210 are not supported.

In response to receiving an ACS landing matrix object 200 with the default online 214 type specified, the ACS landing matrix API 186 instructs the ACS 130 to create a new default online landing matrix 120 from the ACS landing matrix object 200. Then, the ACS 130 assigns the newly created default online landing matrix 214 as the active landing matrix 124, and sends the active landing matrix 124 to the elevator controller 112 to control the access to the floors.

Operators specify the user specific 216 type for the landing matrix type 208 for configuring parameters associated with the user specific online landing matrix 126, also known as a cardholder matrix. The user credentials list 202 is supported for the user specific 216 type value, but the time limit field 210 is not supported. The user credentials list 202 includes the user credentials of authorized users for the floors.

The user specific 216 type also provides the ability to create a new user specific online landing matrix 126 that combines the user credentials in the user credentials list 202 with the values for the front cab door bitmask 202 and rear cab door bitmask 204.

In response to receiving an ACS landing matrix object 200 with the user specific 216 type specified, the ACS landing matrix API 186 instructs the ACS 130 to create a new user specific online landing matrix from the ACS landing matrix object 200.

When users swipe their access cards at the DOPs 104 and COPs 102, the ACS 130 determines if the user credential matches a user credential in the newly created user specific online landing matrix 126. If a match occurs, in response, the ACS 130 sets the newly created user specific online landing matrix 126 as the active landing matrix 124, and sends the active landing matrix 124 to the elevator controller 112 to control the access to the floors.

Operators specify the override 218 value for the landing matrix type 208 for configuring parameters associated with overriding all landing matrices on the ACS 130. The user credentials list 202 and the time limit field 210 are supported for the override type 218.

In response to receiving an ACS landing matrix object 200 with the override 218 value specified for the landing matrix type 208, the ACS Landing matrix API 186 applies the values for the front cab door bitmask 202 and rear cab door bitmask 204 of the received ACS landing matrix object 200, in one example, in a logical exclusive or ("XOR") fashion to all landing matrices on the ACS 130, including the active landing matrix 124.

In other examples, the operator can specify different Boolean operations, or logical operations, for applying the front cab door bitmask 202 and rear cab door bitmask 204 of the received ACS landing matrix object 200 to the landing matrices on the ACS 130. Examples of Boolean operations include logical AND, OR, and exclusive OR ("XOR") operations.

In another example for the override type 218, the user credentials list 202 specifies the user credentials of users, such as emergency personnel, for which the ACS 130 grants access for all floors independent of the values for the front cab door bitmask 202 and rear cab door bitmask 204 in the ACS landing matrix object 200.

The time limit field 210 defines the duration for override events associated with the override type 218. The time limit field 210 supports values associated with fixed time periods, in seconds, and values associated with special events, such as a value that indicates an unlimited time period for executing the override event. The operator must administratively configure the ACS 130 with a landing matrix type 208 other than the override type 218 to end the override event.

FIG. 3 is an exemplary graphical user interface 300 for defining the front cab door bitmask 204 and rear cab door bitmask 206 of the ACS landing matrix object 200 for defining elevator floor access. The example graphical user interface is suitable for usage within the ACS configuration application 188 or the ACS security management application 182.

In the example, the graphical user interface 300 includes checkboxes 301 associated with each floor for the front and rear cab doors. Deselection of a checkbox 301 indicates secured access to the associated floor for the cab door, and selection of a checkbox 301 indicates unsecured access to the associated floor for the cab door.

In response to the selection or deselection of the checkboxes 301, the graphical user interface 300 populates the front cab door bitmask 204 and rear cab door bitmask 206 of an ACS landing matrix object 200.

In one implementation, the graphical user interface 300 is included as part of a configuration "wizard" that creates a new instance of an ACS landing matrix object 200, populates the fields of the ACS landing matrix object 200 in response to operator security objectives, and sends the completed ACS landing matrix object 200 to the ACS 130.

Figure 4:
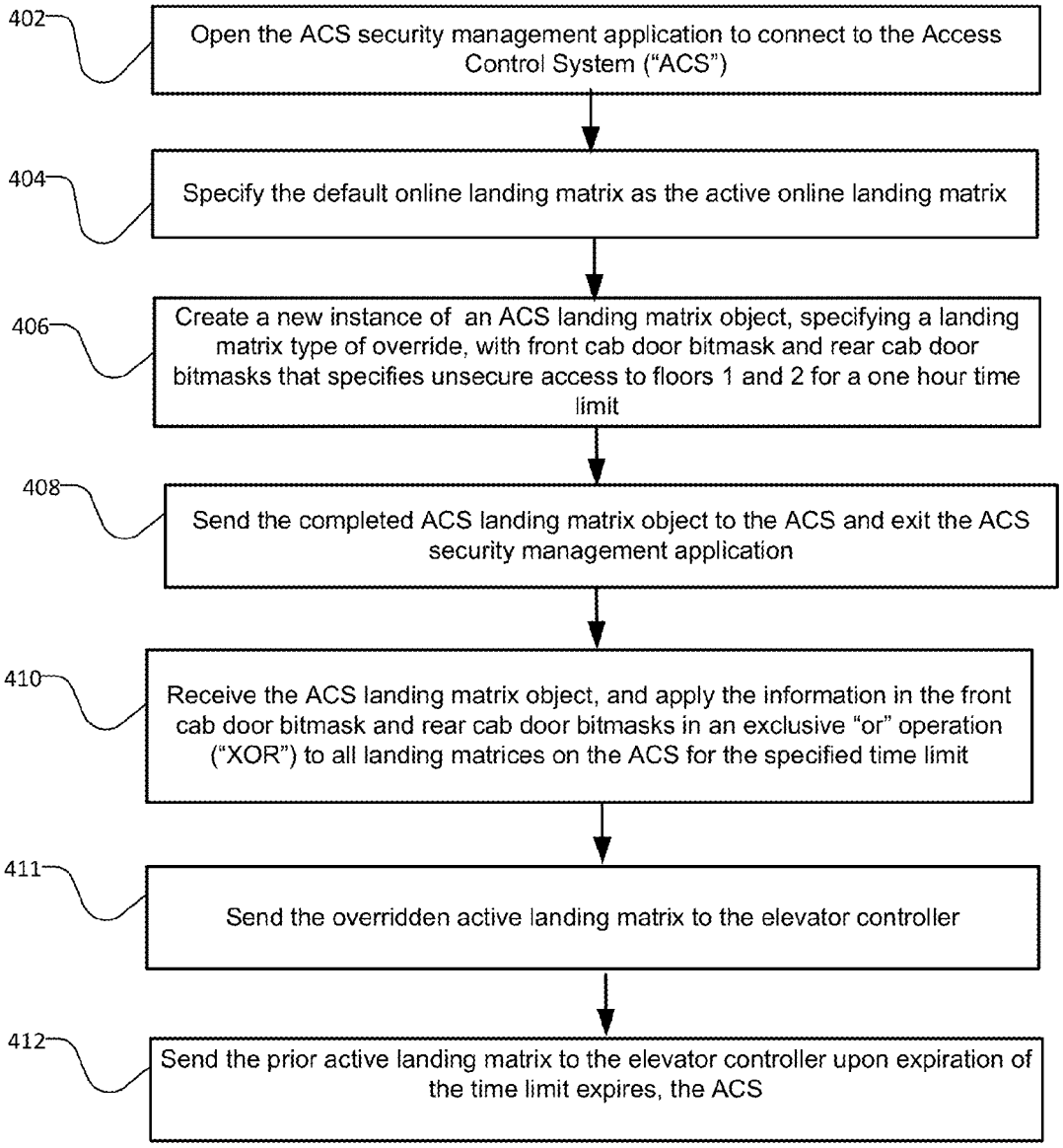
FIG. 4 is a flow diagram illustrating a configuration task by an operator using the ACS security management application of the security guard workstation for overriding the landing matrices on the ACS.

FIG. 4 is a flow diagram illustrating a configuration task by an operator of the ACS for creating and applying an ACS landing matrix object 200 during an override event specified by the override 218 value for the landing matrix type 208.

In step 402, on the security guard workstation, the operator opens the ACS security management application to connect to the Access Control System ("ACS") 130. In step 404, the operator specifies the default online landing matrix 122 as the active online landing matrix 124.

According to step 406, the operator creates a new instance of an ACS landing matrix object 200, specifying the override 218 value for the landing matrix type 208. The operator also specifies values for the front cab door bitmask 204 and rear cab door bitmask 206 that specify unsecure access to floors 1 and 2, and specifies a value in the time limit field 210 associated with a one hour time limit.

In step 408, the operator sends the completed ACS landing matrix object 200 to the ACS 130, and exits the ACS security management application 182. The ACS landing matrix API 186 receives the ACS landing matrix object 200, and applies the information in the front cab door bitmask 204 and rear cab door bitmask 206 in an exclusive "or" operation ("XOR"), in one example, to all landing matrices on the ACS 130 for the specified one hour duration in the time limit field 210, according to step 410.

As a result of step 410, all landing matrices on the ACS 130 are overridden with the contents of the ACS landing matrix object 200, including the active matrix object 124. In step 411, the ACS 130 sends the overridden active landing matrix 124 to the elevator controller 112. When the specified time limit expires, the ACS 130 reverts to using the prior active landing matrix 124, which is the default online landing matrix 122, and sends it to the elevator controller in step 412.

Figure 5:
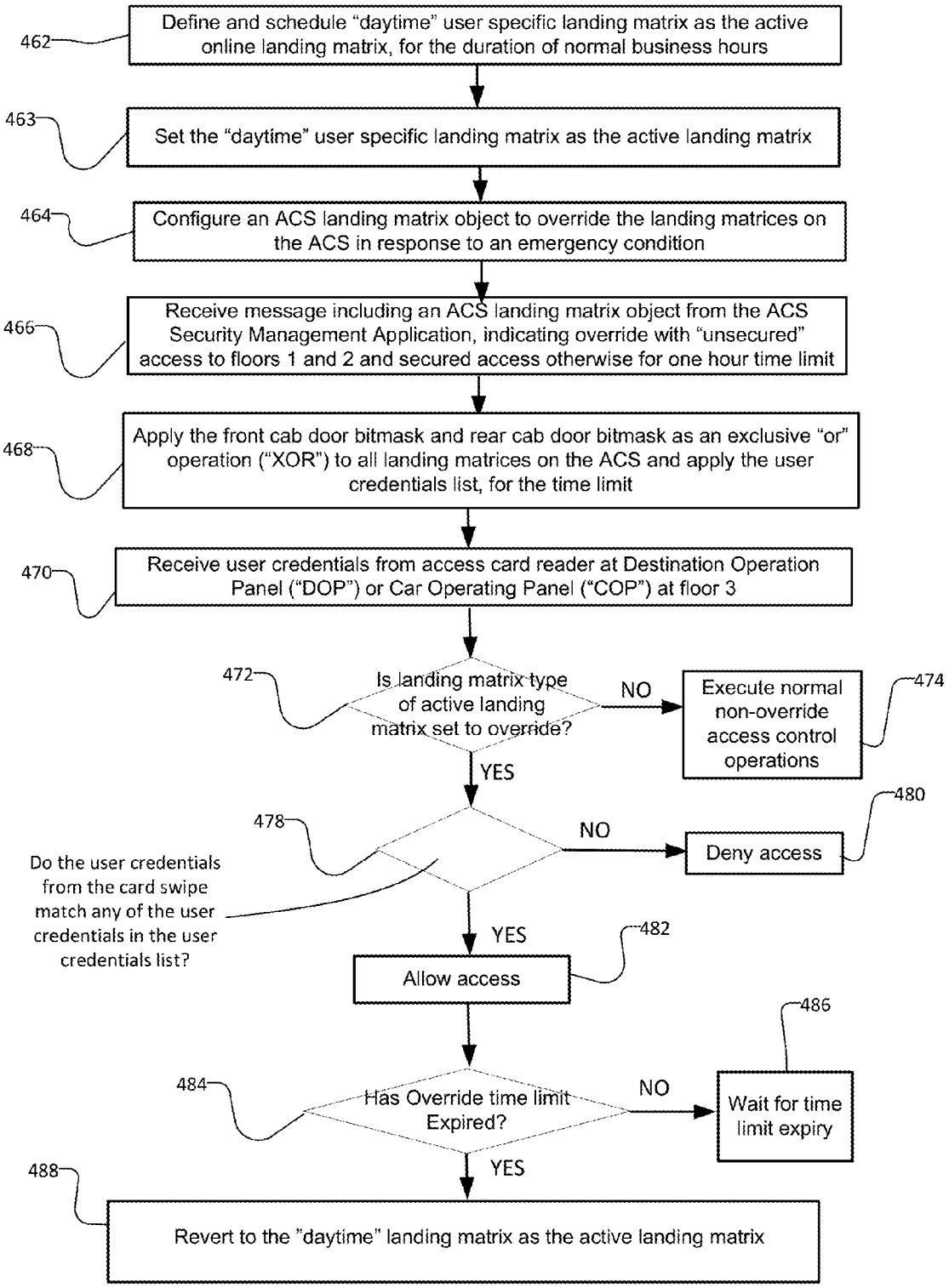
FIG. 5 is a flow diagram that illustrates configuration tasks by operators using the ACS security management application of the security guard workstation to schedule active landing matrices and override the landing matrices on the ACS, and illustrates ACS system behavior in response to the overriding of the landing matrices.

FIG. 5 is a flow chart that illustrates configuration tasks associated with defining and scheduling a new landing matrix as the active online landing matrix 124, overriding the landing matrices in response to emergency conditions, and then illustrates ACS 130 behavior in response to user access requests during the overriding of the landing matrices. Operators perform the configuration tasks for FIG. 5 from the ACS security management application 182 of the security guard workstation 180.

In step 462, using the ACS Security Management Application, the operator defines and schedules a "daytime" user specific landing matrix 126 as the active landing matrix 124, using the scheduler 114. The operator indicates for the scheduler 114 to apply the "daytime" user specific landing matrix 126 for the duration of normal business hours. In step 463, the ACS 130 sets the "daytime" user specific landing matrix 126 as the active landing matrix 124.

In step 464, in response to an emergency condition, the operator uses the ACS Security Management Application to configure an ACS landing matrix object 200 to override the landing matrices on the ACS 130. In the example, the operator populates the ACS landing matrix object 200_with an override 218 value for the landing matrix type 208, and the values for the front cab door bitmask 204 and rear cab door bitmask 206 specify unsecure access to floors 1 and 2, secured access to the remaining floors.

In addition, the operator populates the value in the time limit field 210 to specify a one hour duration for the override event. In addition, the user credentials list 202 includes the user credentials of users for the ACS 130 to provide access to all of the floors independently of the override event. Such users can include first responders to the emergency condition.

In step 466, the ACS receives a message including an ACS landing matrix object 200 from the ACS Security Management Application 182. The contents of the ACS landing matrix object 200 indicate an override event with "unsecured" access to floors 1 and 2 and secured access otherwise for one hour time limit.

In response, according to step 468, the ACS Landing matrix API 186 applies the front cab door bitmask 204 and rear cab door bitmask 206 of the ACS landing matrix object 200 in an exclusive "or" operation ("XOR"), in one example, to all landing matrices on the ACS 130, and applies the user credential list 202, for the one hour specified in the time limit field 210.

In step 470, the ACS receives user credentials from an access card reader 162 at either Destination Operation Panel ("DOP") 104 or Car Operating Panel ("COP") 102 at floor 3. According to step 472, the ACS 130 determines if the value for the landing matrix type 208 is set to override 218. If the result of step 472 is false, the ACS 130 executes non-override operations associated with the active landing matrix 124 in step 474. Otherwise, the ACS 130 proceeds to step 478.

In step 478, the ACS 130 then determines if the user's credentials presented to the card reader 162 match any of the user credentials in the user credentials list 202 of the ACS landing matrix object 200. If the result of step 478 is false, indicating no match, the ACS 130 denies access to the user in step 480. This is because the user has attempted to access floor 3, which the override event has specified has secure access, and the user's credentials are not in the "exemption list" provided by user credentials list 202 of the ACS landing matrix object 200.

If the result of step 478 is true, indicating a match, the ACS 130 allows access to the user for floor 3 in step 482. In step 484, the ACS determines if the time limit of the override has expired. If the duration of the override associated with the value in the time limit field 210 has not expired, the ACS must wait for the override time limit to expire in step 486. Otherwise, the ACS 130 reverts to using the "daytime" landing matrix as the active landing matrix 124 in step 488, as the "daytime" landing matrix in step 464 was defined to be the active landing matrix 124 prior to the override event.

Figure 6:
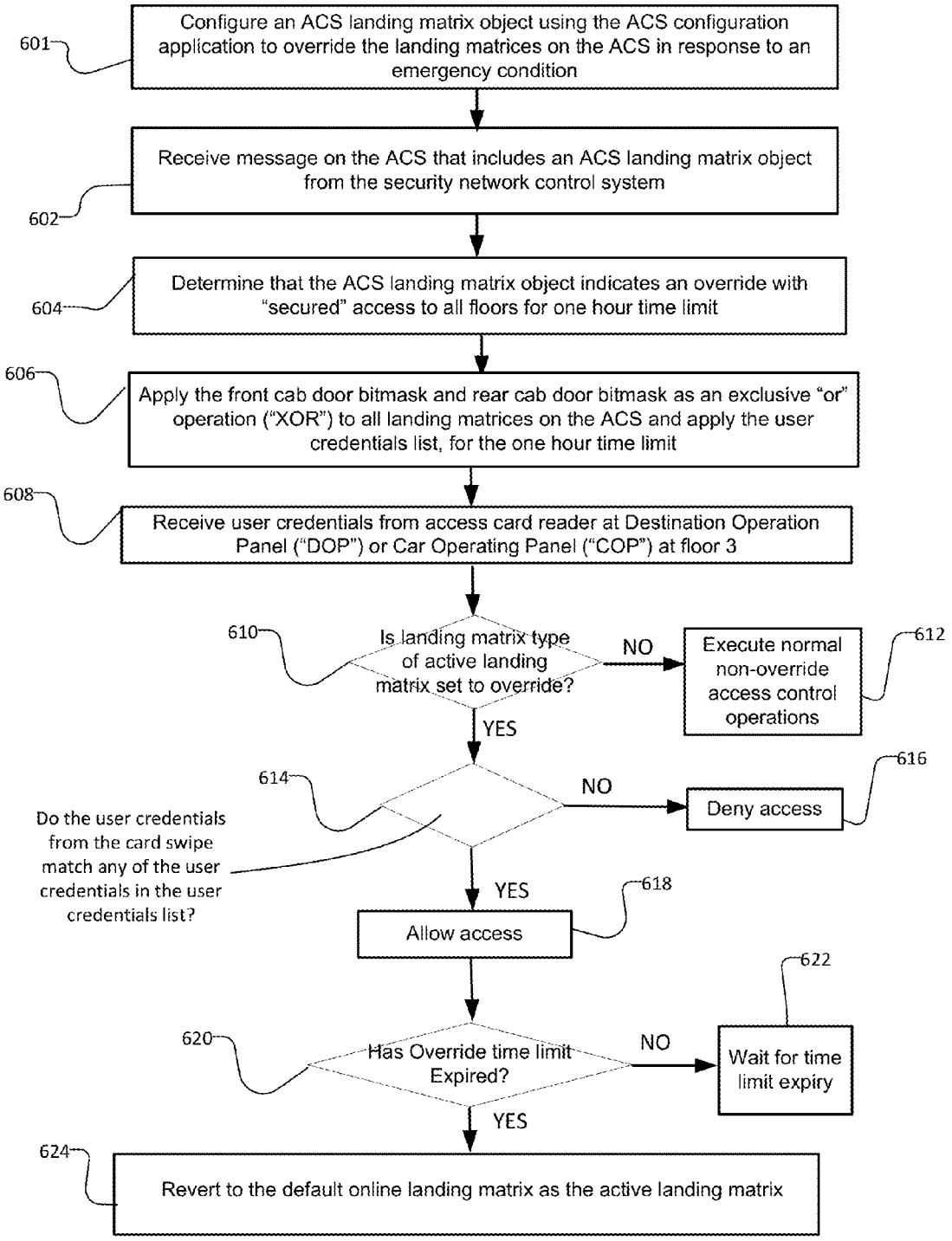
FIG. 6 is a flow diagram that illustrates configuration tasks by operators using the ACS configuration application of the security network control system to override the landing matrices on the ACS, and illustrates ACS system behavior in response to the overriding of the landing matrices.

FIG. 6 is a flow chart that illustrates a configuration task associated with overriding the landing matrices in response to emergency conditions, and then illustrates ACS 130 behavior in response to user access requests during the overriding of the landing matrices. Operators perform the configuration tasks for FIG. 6 from the ACS configuration application 188 of the security network control system 184.

In step 601, in response to an emergency condition, an operator uses the ACS configuration application on the security network control system to configure an ACS landing matrix object 200 to override the landing matrices on the ACS 130. In the example, the operator populates the ACS landing matrix object 200_with an override 218 value for the landing matrix type 208, and the values for the front cab door bitmask 204 and rear cab door bitmask 206 to specify secured access to all floors.

In addition, the operator populates the value in the time limit field 210 to specify a one hour duration for the override event. In addition, the user credentials list 202 includes the user credentials of users for the ACS 130 to provide access to all of the floors independently of the override event. Such users can include first responders to the emergency condition.

In step 602, the ACS 130 receives a message including an ACS landing matrix object 200 from the security network control system 184. In step 604, the ACS landing matrix API 186 determines that the ACS landing matrix object 200 indicates an override with "secured" access to all floors, for a one hour time limit.

According to step 606, the ACS Landing matrix API 186 applies the front cab door bitmask 204 and rear cab door bitmask 206 in an exclusive "or" operation ("XOR"), in one example, to all landing matrices on the ACS 130 and applies the user credentials list 202, for the time limit specified by the time limit field 210.

In step 608, the ACS 130 receives user credentials from an access card reader 162 of either a Destination Operation Panel ("DOP") 104 or Car Operating Panel ("COP") 102 at floor 3, for example. The ACS, in step 610, then determines if the landing matrix type 208 of the ACS landing matrix object 200 is set to override 218. If the result of step 610 is false, the ACS 130 executes non-override operations associated with the active landing matrix 124 in step 612. Otherwise, the ACS 130 proceeds to step 614.

In step 614, the ACS 130 then determines if the user's credentials presented to the card reader 162 match any of the user credentials in the user credentials list 202 of the ACS landing matrix object 200. If the result of step 614 is false, indicating no match, the ACS 130 denies access to the user in step 616. This is because the user has attempted to access floor 3, which the override event has specified has secure access, and the user's credentials are not in the "exemption list" provided by user credentials list 202 of the ACS landing matrix object 200.

If the result of step 614 is true, indicating a match, the ACS 130 allows access to the user for floor 3 in step 618. In step 620, the ACS determines if the time limit of the override has expired. If the duration of the override associated with the value in the time limit field 210 has not expired, the ACS must wait for the override time limit to expire in step 622. Otherwise, the ACS 130 reverts to using the default online landing matrix as the active landing matrix 124 in step 624.

While this invention has been particularly shown and described with references to preferred embodiments thereof, it will be understood by those skilled in the art that various changes in form and details may be made therein without departing from the scope of the invention encompassed by the appended claims.

What is claimed is:

1. A security control system for an elevator system, comprising:

an elevator controller that controls access to floors served by one or more elevators;

an access control system that stores one or more landing matrices that define the access to the floors, the access control system providing the landing matrices to the elevator controller, wherein the access control system includes a landing matrix application programming interface ("API") that accepts landing matrix objects in messages received over a security network, the landing matrix API overriding the landing matrices with the landing matrix objects; and a security network control system that enables configuration of the landing matrix objects, and sends the landing matrix objects in the messages to the access control system over the security network.

2. The system of claim 1, further comprising one or more card readers that receive user credentials from users, and send the user credentials in the messages over the security network to the access control system.

3. The system of claim 2, wherein the card readers are included within car operation panels and/or destination operation panels.

4. The system of claim 1, wherein the landing matrix API creates new landing matrices from the landing matrix objects.

5. The system of claim 1, wherein in response to the messages received over the security network, the access control system selects one of the landing matrices as an active landing matrix, and sends the active landing matrix to the elevator controller to control the access to the floors.

6. The system of claim 1, wherein the elevator controller executes an active landing matrix sent by the access control system to control the access to the floors.

7. The system of claim 1, wherein the elevator controller executes the landing matrices sent by the access control system to control the access to the floors.

8. The system of claim 1, wherein the landing matrices include:

a default offline matrix utilized by the elevator controller when the access control system is unable to communicate with the elevator controller;

one or more user specific matrices associated with cardholders, which the access control system sends to the elevator controller in response to receiving user credentials associated with users, when the access control system authorizes the user credentials for the users; and a default online matrix which the access control system sends to the elevator controller when the access control system communicates with the elevator controller, and no user credentials are received in the messages over the security network.

9. The system of claim 1, wherein the access control system further comprises a scheduler for providing the landing matrices to the elevator controller according to a schedule.

10. The system of claim 1, wherein the security control system includes a configuration application for configuring the landing matrix objects.

11. The system of claim 1, further comprising a security guard workstation that includes a security management application for enabling configuration of the landing matrix objects and for providing the landing matrix objects to the access control system in the messages sent over the security network.

12. The system of claim 11, wherein the security guard workstation includes:

a display device for displaying the security management application; and a keyboard and a pointing device for configuring the landing matrix objects in the security management application.

13. The system of claim 1, wherein the landing matrix objects provide a vendor-neutral format for overriding the landing matrices sent to the elevator controller.

14. The system of claim 1, wherein the landing matrix objects include:

bitmasks for defining the access to the floors associated with cab doors of the elevators;

a user credentials list that includes user credentials for defining the access to the floors associated with users;

a landing matrix type field that defines operations for the landing matrix API to perform from contents of the landing matrix objects; and a time limit field that specifies a duration associated with the operations of the landing matrix type field.

15. A security control method for an elevator system, comprising:

an access control system providing a landing matrix application programming interface ("API") that accepts landing matrix objects in messages received over a security network;

in the access control system, storing one or more landing matrices defining access to floors by one or more elevators;

the access control system receiving the landing matrix objects from a security network control system, and overriding the stored landing matrices with the landing matrix objects; and providing the landing matrices to an elevator controller of the elevator.

16. The method of claim 15, further comprising receiving user credentials from users via card readers, and sending the user credentials in the messages over the security network to the access control system.

17. The method of claim 15, further comprising the landing matrix API creating new landing matrices from the landing matrix objects.

18. The method of claim 15, wherein in response to receiving the messages over the security network, the access control system selecting one of the landing matrices as an active landing matrix, and sending the active landing matrix to the elevator controller to control the access to the floors.

19. The method of claim 15, further comprising the elevator controller executing an active landing matrix sent by the access control system to control the access to the floors.

20. The method of claim 15, further comprising the elevator controller executing the landing matrices sent by the access control system to control the access to the floors.

21. The method of claim 15, further comprising providing the landing matrices to the elevator controller according to a schedule.

22. The method of claim 15, further comprising providing a vendor-neutral format for overriding the landing matrices sent to the elevator controller.

23. The method of claim 15, further comprising overriding the landing matrices by:

applying bitmasks of the landing matrix objects that define the access to the floors, associated with cab doors of the elevators, to the landing matrices; and replacing user credentials of the landing matrices associated with users that define the access to the floors, with user credentials of the landing matrix objects.

24. The method of claim 15, further comprising overriding the landing matrices with the landing matrix objects for controlling the access to the floors for a specified period of time.

25. The method of claim 15, further comprising overriding the landing matrices with the landing matrix objects for controlling the access to the floors for a specified period of time, and then after the specified period of time as expired, reverting back to the landing matrices.

26. The system of claim 1, wherein the landing matrix objects include a time limit field that specifies a duration associated with the operations of the landing matrix objects, wherein the access control system reverts back to the stored landing matrices after the duration associated with the operations of the landing matrix objects has expired.

* * * * *